US008342499B2

(12) United States Patent
Shiraishi et al.

(10) Patent No.: US 8,342,499 B2
(45) Date of Patent: Jan. 1, 2013

(54) SHEET PROCESSING APPARATUS AND SHEET PROCESSING SYSTEM

(75) Inventors: Ryuuichi Shiraishi, Kanagawa (JP); Ryuichi Sato, Kanagawa (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 0 days.

(21) Appl. No.: 12/910,523

(22) Filed: Oct. 22, 2010

(65) Prior Publication Data

US 2011/0233844 A1 Sep. 29, 2011

(30) Foreign Application Priority Data

Mar. 29, 2010 (JP) ..... 2010-076055

(51) Int. Cl.
*B65H 37/04* (2006.01)

(52) U.S. Cl. ..... 270/58.08; 270/52.18; 270/58.07; 270/58.12

(58) Field of Classification Search ..... 270/37, 270/52.18, 58.07, 58.12, 58.08; 412/6, 8, 412/18, 33, 35, 36, 37, 38; 399/408, 410; 283/100, 103, 105
See application file for complete search history.

(56) References Cited

U.S. PATENT DOCUMENTS

| | | | | |
|---|---|---|---|---|
| 4,586,640 | A * | 5/1986 | Smith | 227/14 |
| 5,447,402 | A * | 9/1995 | Kobayashi | 412/33 |
| 5,717,843 | A * | 2/1998 | Tabata et al. | 358/1.18 |
| 5,992,889 | A * | 11/1999 | Barnett et al. | 283/56 |
| 7,578,497 | B2 * | 8/2009 | Kawata et al. | 270/37 |
| 7,624,976 | B2 * | 12/2009 | Koie | 270/58.12 |

FOREIGN PATENT DOCUMENTS

| | | |
|---|---|---|
| JP | 2000-318918 | 11/2000 |
| JP | 3885410 A | 12/2006 |

* cited by examiner

*Primary Examiner* — Leslie A Nicholson, III
(74) *Attorney, Agent, or Firm* — Sughrue Mion, PLLC

(57) ABSTRACT

A sheet processing apparatus includes a support unit on which sheets, which each include first and second edge portions that differ from each other, are stacked together such that the first and second edge portions are aligned; a counter member disposed so as to face the first edge portions; a pressing member that presses the first edge portions against the counter member; a first binding unit that binds together the first edge portions by a first binding process, the first edge portion of each sheet being pressed against the counter member by the pressing member; and a second binding unit that binds together the second edge portions by a second binding process, the first edge portion of each sheet being pressed against the counter member by the pressing member, a bond formed by the second binding unit being more easily breakable than a bond formed by the first binding unit.

20 Claims, 8 Drawing Sheets

SHEET PROCESSING APPARATUS AND SHEET PROCESSING SYSTEM

CROSS-REFERENCE TO RELATED APPLICATIONS

This application is based on and claims priority under 35 USC 119 from Japanese Patent Application No. 2010-076055 filed Mar. 29, 2010.

BACKGROUND

The present invention relates to a sheet processing apparatus and a sheet processing system.

SUMMARY

According to an aspect of the invention, a sheet processing apparatus includes a support unit on which a plurality of sheets are stacked, each sheet including a first edge portion and a second edge portion that differs from the first edge portion, the sheets being stacked together as a sheet stack such that the first edge portions and the second edge portions of the sheets are aligned; a counter member disposed so as to face the first edge portions of the sheets stacked on the support unit; a pressing member that presses the first edge portions of the sheets stacked on the support unit against the counter member; a first binding unit that binds together the first edge portions of the sheets in the sheet stack by a first binding process, the first edge portion of each sheet being pressed against the counter member by the pressing member; and a second binding unit that binds together the second edge portions of the sheets in the sheet stack by a second binding process, the first edge portion of each sheet being pressed against the counter member by the pressing member, a bond formed by the second binding unit being more easily breakable than a bond formed by the first binding unit.

BRIEF DESCRIPTION OF THE DRAWINGS

An Exemplary embodiment of the present invention will be described in detail based on the following figures, wherein.

DETAILED DESCRIPTION

An exemplary embodiment of the present invention will now be described in detail with reference to the accompanying drawings.

Image Forming System 1

Figure 1:
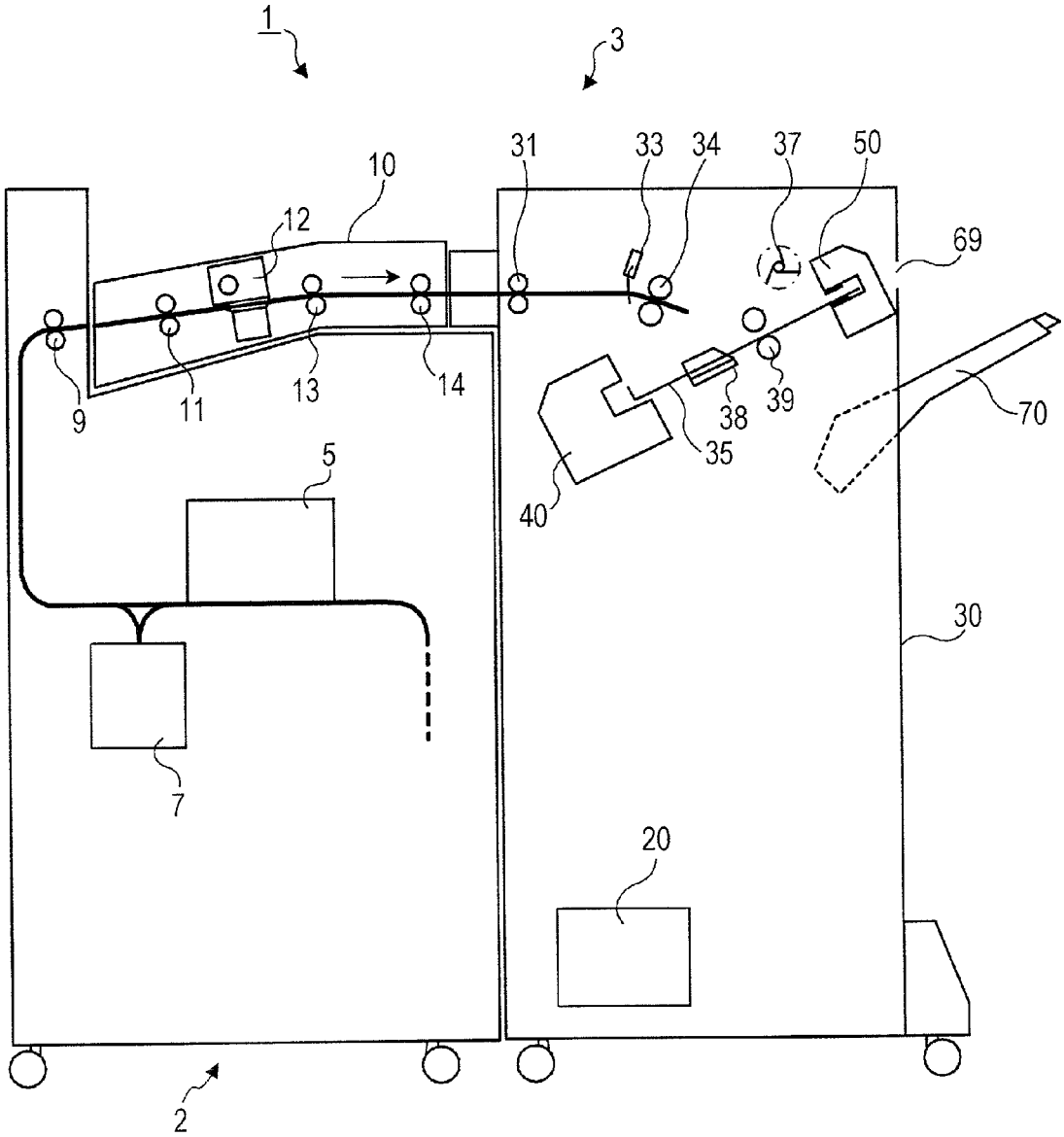
FIG. 1 is a schematic diagram illustrating an image forming apparatus to which an exemplary embodiment of the present invention is applied.

FIG. 1 is a schematic diagram illustrating an image forming system 1 to which the present exemplary embodiment is applied. The image forming system 1 illustrated in FIG. 1 includes an image forming apparatus 2 and a paper-sheet processing apparatus 3. The image forming apparatus 2 is, for example, a printer or a copy machine which forms an image by an electrophotographic system. The paper-sheet processing apparatus 3 is an example of a sheet processing apparatus and performs post-processing for a paper sheet S. The paper sheet S is an example of a sheet on which a toner image, for example, is formed by the image forming apparatus 2.

The image forming apparatus 2 includes an image forming unit 5 which forms an image on the paper sheet S, a paper-sheet reversing device 7 which reverses the paper sheet S on which the image has been formed by the image forming unit 5, and eject rollers 9 which eject the paper sheet S on which the image has been formed.

The paper-sheet processing apparatus 3 includes a transporting device 10 and a post-processing device 30. The transporting device 10 receives the paper sheet S output from the image forming apparatus 2 and transports the paper sheet S further downstream. The post-processing device 30 includes a compiling support unit 35 on which multiple paper sheets S are collected and stacked and a stapler 40 which binds edge portions of the paper sheets S together. The paper-sheet processing apparatus 3 also includes a controller 20 that controls the overall operation of the paper-sheet processing apparatus 3.

Paper-Sheet Processing Apparatus 3

The structure of the paper-sheet processing apparatus 3 will now be described in more detail. The transporting device 10 included in the paper-sheet processing apparatus 3 includes inlet rollers 11, which are a pair of rollers that receive the paper sheet S output from the image forming apparatus 2 through the eject rollers 9, and a puncher 12 that punches a hole in the paper sheet S received by the inlet rollers 11. The transporting device 10 also includes first transporting rollers 13 and second transporting rollers 14 that are disposed downstream of the puncher 12. The first transporting rollers 13 are a pair of rollers that transport the paper sheet S further downstream, and the second transporting rollers 14 are a pair of rollers that transport the paper sheet S toward the post-processing device 30.

The post-processing device 30 included in the paper-sheet processing apparatus 3 includes receiving rollers 31, which are a pair of rollers that receive the paper sheet S from the transporting device 10. The post-processing device 30 also includes an exit sensor 33, the compiling support unit 35, and exit rollers 34. The exit sensor 33 is disposed downstream of the receiving rollers 31 and detects the paper sheet S. The compiling support unit 35 is an example of a support unit, and multiple paper sheets S are collected and stacked on the compiling support unit 35. The exit rollers 34 are a pair of rollers disposed downstream of a position at which each paper sheet S is detected by the exit sensor 33, and eject the paper sheet S toward the compiling support unit 35. The post-processing device 30 also includes a paddle unit 37, which is an example of a pressing member, a front-edge pressing portion, a positioning unit, and a transporting unit, and rotates so as to push each paper sheet S toward an end guide 35*b* (described below) of the compiling support unit 35. The post-processing device 30 also includes a tamper 38, which is an example of the pressing member, a side-edge pressing portion, and the positioning unit, and pushes each paper sheet S toward a side guide 35*c* (described below) of the compiling support unit 35. The post-processing device 30 also includes eject rollers 39 which press the paper sheets S stacked on the compiling support unit 35 and transport the stack of paper sheets S in a bound state toward the downstream side.

The post-processing device 30 also includes the stapler 40 and a staple-free binding device 50. The stapler 40 is an example of a first binding unit, and binds edge portions of the paper sheets S stacked on the compiling support unit 35 together using staples. The staple-free binding device 50 is an example of a second binding unit, and binds edge portions of the paper sheets S together without using staples. The post-processing device 30 also includes an opening 69 through which the stack of paper sheets S is ejected and a stacker 70 on which stacks of paper sheets S subjected to post-processing are stacked such that the user may easily take the stacks of paper sheets S.

Structure Around Binding Units

Figure 2:
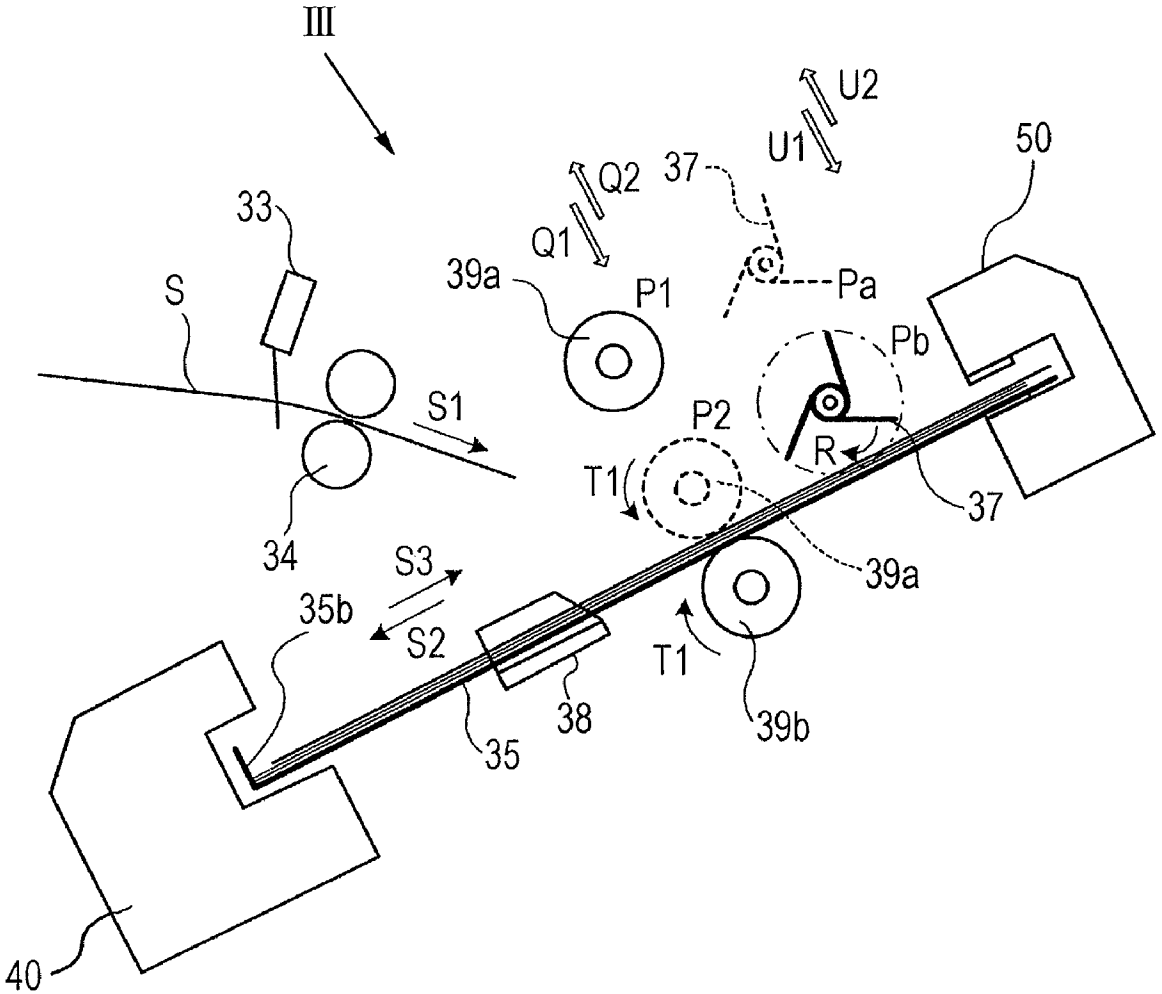
FIG. 2 is a schematic diagram illustrating an area around a compiling support unit.
Figure 3:
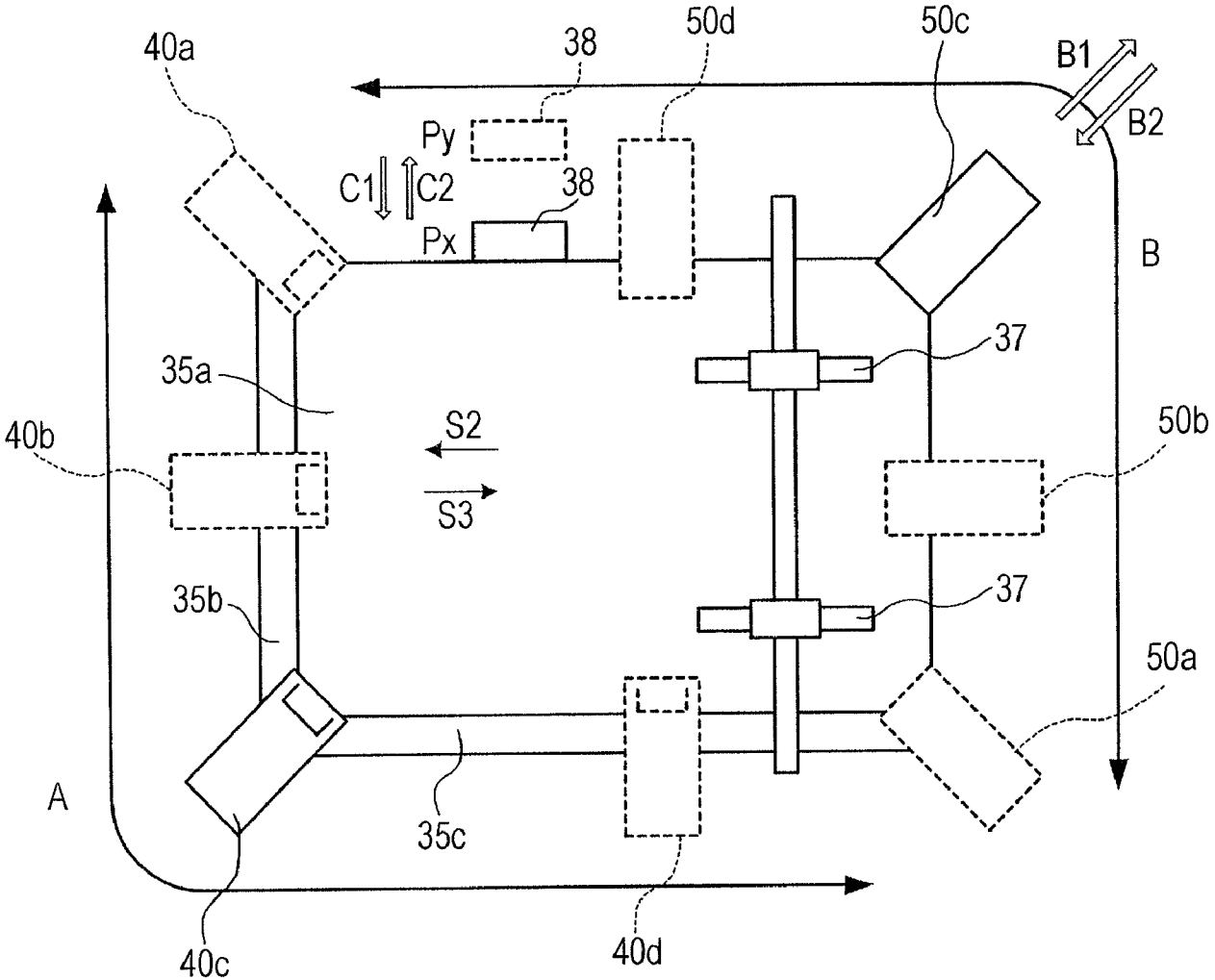
FIG. 3 is a schematic diagram illustrating the area around the compiling support unit viewed in a direction shown by arrow III in FIG. 2.

Next, the compiling support unit 35 and devices, such as the stapler 40 and the staple-free binding device 50, disposed around the compiling support unit 35 will be described with reference to FIGS. 2 and 3. FIG. 2 is a schematic diagram illustrating an area around the compiling support unit 35, and FIG. 3 is a schematic diagram illustrating the area around the compiling support unit 35 viewed in a direction shown by arrow III in FIG. 2. In FIG. 3, the lower side corresponds to a side of the image forming system 1 that faces the user, that is, a front side in FIG. 1.

For simplicity, some components, such as the eject rollers 39, are not illustrated in FIG. 3.

The compiling support unit 35 includes a bottom portion 35*a* that has an upper surface on which the paper sheets S are stacked, the end guide 35*b*, and the side guide 35*c*. The end guide 35*b* and the side guide 35*c* are examples of a counter member and the positioning unit, and are disposed at the periphery of the bottom portion 35*a*.

In the area around the compiling support unit 35, each paper sheet S is transported toward the compiling support unit 35 (in a first moving direction S1 in FIG. 2), and then the moving direction of the paper sheet S is reversed such that the paper sheet S slides downward along the bottom portion 35*a* of the compiling support unit 35 (in a second moving direction S2 in FIG. 2). Then, the moving direction of the paper sheet S is reversed again such that the paper sheet S moves upward along the bottom portion 35*a* of the compiling support unit 35 (in a third moving direction S3 in FIG. 2). The movement of the paper sheet S will be described in more detail below.

The structures of the end guide 35*b*, which is an example of a front-edge counter portion, and the side guide 35*c*, which is an example of a side-edge counter portion, will now be described in terms of their positional relationship with the paper sheets S.

The end guide 35*b* includes a surface that is substantially perpendicular to the bottom portion 35*a* at a front end of the bottom portion 35*a* in the moving direction of each paper sheet S that slides downward along the upper surface of the bottom portion 35*a* (the downstream end in the second moving direction S2 in FIG. 2). Thus, the end guide 35*b* aligns an edge portion of each paper sheet S that slides downward along the bottom portion 35*a* at a front end of the paper sheet S in the moving direction thereof. The side guide 35*c* includes a surface that is substantially perpendicular to the bottom portion 35*a* and extends substantially parallel to the direction in which each paper sheet S slides downward along the bottom portion 35*a* (the second moving direction S2 in FIG. 2). Thus, the side guide 35*c* aligns an edge portion of the paper sheet S at a side that is substantially parallel to the direction in which the paper sheet S slides downward along the bottom portion 35*a*.

The paddle unit 37 is positioned above the compiling support unit 35 and downstream of the exit rollers 34 in the first moving direction S1 of each paper sheet S. The paddle unit 37 is driven by a motor or the like such that a distance between the paddle unit 37 and the bottom portion 35*a* of the compiling support unit 35 changes. More specifically, the paddle unit 37 is movable in directions shown by arrows U1 and U2 in FIG. 2. The paddle unit 37 moves in the direction shown by arrow U1 to a position near the bottom portion 35*a* of the compiling support unit 35 (position Pb at which the paddle unit 37 is drawn by solid lines), and moves in the direction shown by arrow U2 to a position separated from the bottom portion 35*a* of the compiling support unit 35 (position Pa at which the paddle unit 37 is drawn by dashed lines). The paddle unit 37 pushes each paper sheet S along the compiling support unit 35 in the second moving direction S2 in FIG. 2 by rotating in a direction shown by arrow R in FIG. 2 after the paper sheet S is transported along the first moving direction S1.

The tamper 38 is provided at one of two sides of the compiling support unit 35, more specifically, at a side opposite to the side at which the side guide 35*c* is provided. The tamper 38 is driven by a motor or the like such that a distance between the tamper 38 and the side guide 35*c* of the compiling support unit 35 changes. In the present exemplary embodiment, the tamper 38 is disposed at a side of the compiling support unit 35 opposite to the side shown in FIG. 2, that is, at an upper side in FIG. 3. The tamper 38 moves in a direction shown by arrow C1 in FIG. 3 to a position near the compiling support unit 35 (position Px at which the tamper 38 is drawn by solid lines). The tamper 38 moves in a direction shown by arrow C2 in FIG. 3 to a position separated from the compiling support unit 35 (position Py at which the tamper 38 is drawn by dashed lines). Thus, the tamper 38 pushes the paper sheets S stacked on the compiling support unit 35 in the direction shown by arrow C1 by moving in the direction shown by arrow C1. In the present exemplary embodiment, positions Px and Py of the tamper 38 may be changed in accordance with the size and orientation of the paper sheets S supplied to the compiling support unit 35.

The eject rollers 39 include a first eject roller 39*a* and a second eject roller 39*b*. The first eject roller 39*a* and the second eject roller 39*b* are opposed to each other with the bottom portion 35*a* of the compiling support unit 35 positioned therebetween. The first eject roller 39*a* is provided adjacent to the bottom portion 35*a* of the compiling support unit 35 at a side at which the paper sheets S are stacked. The first eject roller 39*a* is driven by a motor or the like such that the first eject roller 39*a* moves toward or away from the second eject roller 39*b*. In other words, a distance between the first eject roller 39*a* and the stack of paper sheets S placed between the first eject roller 39*a* and the second eject roller 39*b* is changeable. The second eject roller 39*b* is disposed adjacent to the bottom portion 35*a* of the compiling support unit 35 at a side opposite to the side at which the paper sheets S are stacked. The position of the second eject roller 39*b* is fixed, and the second eject roller 39*b* only rotates.

The first eject roller 39*a* moves in a direction shown by arrow Q1 to a position where the first eject roller 39*a* is near the bottom portion 35*a* of the compiling support unit 35 (position P2 at which the first eject roller 39*a* is drawn by dashed lines). The first eject roller 39*a* moves in a direction shown by arrow Q2 to a position where the first eject roller 39*a* is separated from the bottom portion 35*a* of the compiling support unit 35 (position P1 at which the first eject roller 39*a* is drawn by solid lines).

The first eject roller 39*a* is driven by a motor or the like (not shown) so as to rotate in a direction shown by arrow T1 while the first eject roller 39*a* is in contact with the stack of paper sheets S. Accordingly, the stack of paper sheets S is transported downstream (in the third moving direction S3).

The positions P1 and P2 of the first eject roller 39*a* may be changed in accordance with the number of paper sheets S supplied to the compiling support unit 35 and the thickness of the paper sheets S.

Figure 4:
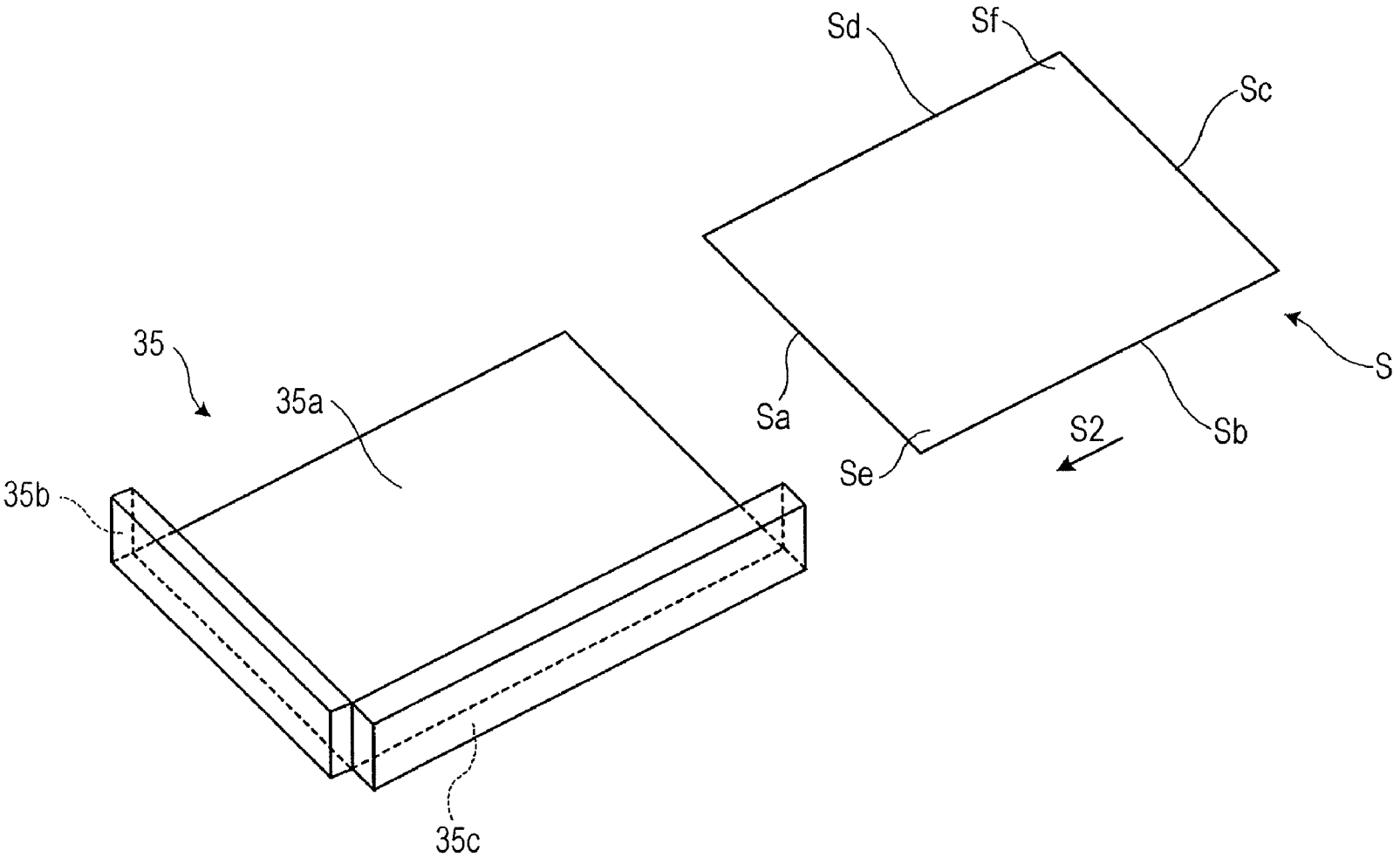
FIG. 4 is a conceptual diagram illustrating edge portions of a paper sheet.

The definition of edge portions of each paper sheet S supplied to the compiling support unit 35 in the present exemplary embodiment will now be described with reference to FIG. 4. FIG. 4 is a conceptual diagram illustrating the edge portions of the paper sheet S.

In the present exemplary embodiment, each of the edge portions of the paper sheet S is defined in terms of its relationship with the second moving direction S2, which is the direction in which the paper sheet S slides downward along the upper surface of the bottom portion 35*a* of the compiling support unit 35. An edge portion of the paper sheet S at the front end thereof in the second moving direction S2 is called an end-guide edge portion Sa. The end-guide edge portion Sa comes into contact with the end guide 35*b*.

An edge portion at an end opposite to the end-guide edge portion Sa, that is, an edge portion of the paper sheet S at the rear end thereof in the second moving direction S2, is called an end-guide-free edge portion Sc.

An edge portion of the paper sheet S that extends in the second moving direction S2 at a side at which the side guide 35*c* is provided is called a side-guide edge portion Sb. The side-guide edge portion Sb comes into contact with the side guide 35*c*.

An edge portion at a side opposite to the side-guide edge portion Sb, that is, an edge portion of the paper sheet S that extends substantially parallel to the direction in which the paper sheet S slides downward and that is at a side opposite to the side at which the side guide 35*c* is provided, is called a side-guide-free edge portion Sd.

A corner portion between the end-guide edge portion Sa and the side-guide edge portion Sb is called a guide corner portion Se. A corner portion between the end-guide-free edge portion Sc and the side-guide-free edge portion Sd is called a guide-free corner portion Sf. In the present exemplary embodiment, the meaning of "substantially perpendicular" includes perpendicular, and the meaning of "substantially parallel" includes parallel.

Further explanations will now be given with reference to FIGS. 2 and 3.

Stapler 40

The stapler 40 binds edge portions of the paper sheets S stacked on the compiling support unit 35 together by pushing staples into the paper sheets S one by one. The stapler 40 is movable along the periphery of the compiling support unit 35. More specifically, the stapler 40 is movable along a stapler rail (not shown), which is provided along the periphery of the compiling support unit 35, in directions shown by arrow A in FIG. 3. A stapler motor (not shown) is provided as a drive source for moving the stapler 40 along the stapler rail. The stapler 40 may be disposed at the side that faces the user (lower side in FIG. 3), so that processes for the stapler 40, such as refilling of the stapler 40 with the staples, may be easily performed.

The stapler rail includes a portion that extends substantially parallel to the longitudinal direction of the end guide 35*b* provided on the compiling support unit 35 (vertical direction in FIG. 3), a portion that extends substantially parallel to the longitudinal direction of the side guide 35*c* (horizontal direction in FIG. 3), and a corner portion that connects the above-mentioned portions. Accordingly, as illustrated in FIG. 3, the paper sheets S may be stapled at any of the end-guide edge portion Sa, the side-guide edge portion Sb, and the guide corner portion Se of each paper sheets S. In addition, the position at which the paper sheets S are stapled may be arbitrarily changed at the edge portions and the corner portion (see 40*a* to 40*d* in FIG. 3). In the present exemplary embodiment, the position of the stapler rail is fixed with respect to the compiling support unit 35. In addition, in the present exemplary embodiment, a home position of the stapler 40 is a position at which a staple may be pushed into the guide corner portions Se of the paper sheets S (see 40*c* in FIG. 3).

Staple-Free Binding Device 50

The staple-free binding device 50 binds edge portions of the paper sheets S stacked on the compiling support unit 35 together without using the staples, as described in detail below. The staple-free binding device 50 is movable along the periphery of the compiling support unit 35. More specifically, the staple-free binding device 50 is movable along a staple-free-binding-device rail (not shown), which is provided along the periphery of the compiling support unit 35, in directions shown by arrow B in FIG. 3. A staple-free-binding-device motor (not shown) is provided as a drive source for moving the staple-free binding device 50 along the staple-free-binding-device rail. Although the stapler 40 is refilled with staples as necessary, such a process is not necessary for the staple-free binding device 50.

The staple-free-binding-device rail includes a portion that extends substantially parallel to the longitudinal direction of the edge of the compiling support unit 35 at the end opposite to the end guide 35*b* (vertical direction in FIG. 3), a portion that extends substantially parallel to the longitudinal direction of the edge of the compiling support unit 35 at the side opposite to the side guide 35*c* (horizontal direction in FIG. 3), and a corner portion that connects the above-mentioned portions. Accordingly, as illustrated in FIG. 3, the paper sheets S may be bound together at any of the end-guide-free edge portion Sc, the side-guide-free edge portion Sd, and the guide-free corner portion Sf each paper sheet S. In addition, the position at which the paper sheets S are bound together may be arbitrarily changed at the edge portions and the corner portion (see 50*a* to 50*d* in FIG. 3). In addition, in the present exemplary embodiment, a home position of the staple-free binding device 50 is a position at which the guide-free corner portions Sf of the paper sheets S may be bound together (see 50*c* in FIG. 3). The home position of the staple-free binding device 50 is not limited to the position denoted by 50*c* in FIG. 3 as long as the staple-free binding device 50 does not interfere with the stack of paper sheets S when the stack of paper sheets S is transported. For example, the home position of the staple-free binding device 50 may be a position at which the staple-free binding device 50 is opposed to the side guide 35*c* (see 50*d* in FIG. 3).

The position of the staple-free-binding-device rail (not shown) may be changed in accordance with the size and orientation of the paper sheets S supplied to the compiling support unit 35. More specifically, the staple-free-binding-device rail is movable such that a distance between the staple-free-binding-device rail and the end guide 35*b* and a distance between the staple-free-binding-device rail and the side guide 35*c* may be changed (see arrows B1 and B2 in FIG. 3).

Figure 5A:
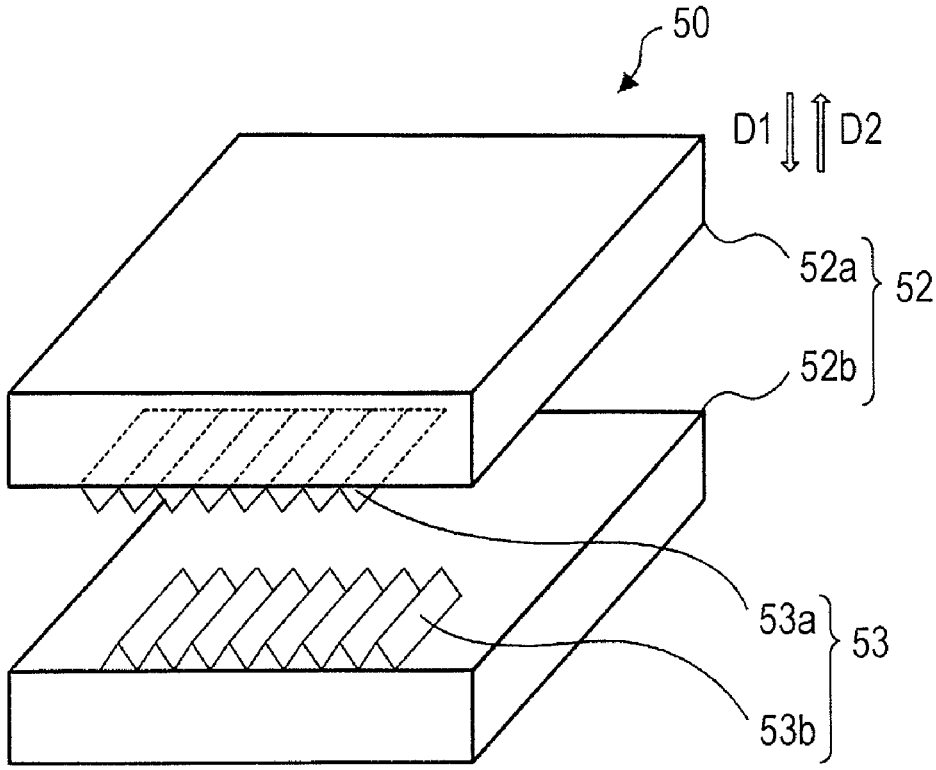
FIG. 5A is a schematic diagram illustrating a staple-free binding device.
Figure 5B:
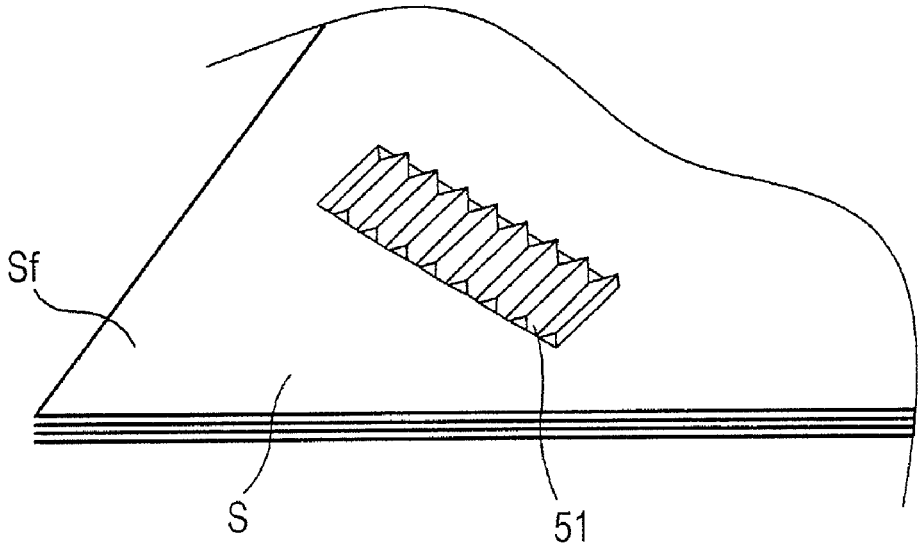
FIG. 5B is a conceptual diagram illustrating an embossed mark formed by the staple-free binding device.

Next, the structure of the staple-free binding device 50 will be described in detail with reference to FIGS. 5A and 5B. FIG. 5A is a schematic perspective view of the staple-free binding device 50 and FIG. 5B illustrates the edge portions, more specifically, the guide-free corner portions Sf of the paper sheets S processed by the staple-free binding device 50.

The staple-free binding device 50 includes pressing portions 52 and embossed-mark forming portions 53. The pressing portions 52 move toward each other to apply a pressure for processing the edge portions of the paper sheets S. The embossed-mark forming portions 53 receive the pressure applied by the pressing portions 52 and process the paper sheets S so as to bind the paper sheets S together.

The pressing portions 52 include an upper pressing portion 52*a* and a lower pressing portion 52*b*. The upper pressing portion 52*a* is movable toward and away from the lower pressing portion 52*b* (see arrows D1 and D2 in FIG. 5A) by an upper-pressing-portion motor (not shown), and applies a pressure to the paper sheets S placed between the upper pressing portion 52*a* and the lower pressing portion 52*b*.

The embossed-mark forming portions 53 include a projecting portion 53*a* and a receiving portion 53*b*. The projecting portion 53*a* is provided on the upper pressing portion 52*a* and the receiving portion 53*b* is provided on the lower pressing portion 52*b*. The projecting portion 53*a* and the receiving portion 53*b* process the paper sheets S placed therebetween.

More specifically, the projecting portion 53*a* includes a surface that has projections and recesses and that faces the receiving portion 53*b*, and the receiving portion 53*b* includes a surface that has projections and recesses and that faces the projecting portion 53*a*. The surface of the projecting portion 53*a* having the projections and recesses and the surface of the receiving portion 53*b* having the projections and recesses are substantially parallel to each other, and are arranged such that projections on the projecting portion 53*a* mesh with recesses in the receiving portion 53*b*. The projecting portion 53*a* and the receiving portion 53*b* mesh with each other while a pressure is applied by the pressing portions 52. Accordingly, the paper sheets S are processed. Referring to FIG. 5B, an embossed mark 51 is formed at the processed part of the paper sheets S, and the shape of the processed part corresponds to the shapes of the projecting portion 53*a* and the receiving portion 53*b*. The embossed mark 51 is an example of a projection and a recess that extend in a direction in which the sheets are stacked, and serves to bind the paper sheets S together without using the staples.

Next, the manners in which the paper sheets S are bound together by the post-processing device 30 according to the present exemplary embodiment will be described with reference to FIGS. 6A to 6E. FIGS. 6A to 6E are conceptual diagrams illustrating examples of stacks of paper sheets S subjected to a process according to the present exemplary embodiment.

Referring to FIGS. 6A to 6E, staples 411 to 413 shown as black rectangles indicate the positions at which the paper sheets S have been bound together by the stapler 40, and embossed marks 511 to 514 shown as white rectangles indicate the positions at which the paper sheets S have been bound together by the staple-free binding device 50.

First, the stack of paper sheets S illustrated in FIG. 6A will be described. In this stack of paper sheets S, three staples 411 to 413 are provided to bind the side-guide edge portions Sb together, and two embossed marks 511 and 512 are provided to bind the side-guide-free edge portions Sd together. Thus, the staples 411 to 413 and the embossed marks 511 and 512 are provided at the edge portions of each paper sheet S that are opposed to each other.

Next, the stack of paper sheets S illustrated in FIG. 6B will be described. In this stack of paper sheets S, two staples 411 and 412 are provided to bind the end-guide edge portions Sa together, and two embossed marks 511 and 512 are provided to bind the end-guide-free edge portions Sc together. Thus, the staples 411 and 412 and the embossed marks 511 and 512 are provided at the edge portions of each paper sheet S that are opposed to each other.

Next, the stack of paper sheets S illustrated in FIG. 6C will be described. A single staple 411 is provided to bind the guide corner portions Se together, and a single embossed mark 511 is provided to bind the guide-free corner portions Sf together. Thus, the staple 411 and the embossed mark 511 are provided at corner portions of each paper sheet S that are opposed to each other.

Next, the stack of paper sheets S illustrated in FIG. 6D will be described. In this stack of paper sheets S, three staples 411 to 413 are provided to bind the side-guide edge portions Sb together. In addition, four embossed marks 511 to 514 are provided to bind the side-guide-free edge portions Sd and the end-guide-free edge portions Sc together.

Next, the stack of paper sheets S illustrated in FIG. 6E will be described. In this stack of paper sheets S, three staples 411 to 413 are provided to bind the side-guide edge portions Sb together. In addition, two embossed marks 511 to 512 are provided to bind the end-guide-free edge portions Sc together. In the stack of paper sheets S illustrated in FIG. 6E, different from the stacks of paper sheets S illustrated in FIGS. 6A to 6D, the paper sheets S are bound together at the adjacent edge portions of each paper sheet S.

Although the stacks of paper sheets S illustrated in FIGS. 6A to 6E are described above, these stacks of paper sheets S are merely examples, and the post-processing device 30 according to the present exemplary embodiment may be used to bind the paper sheets S in manners different from those in the above-described examples. For example, the positions and numbers of parts of the stack of paper sheets S at which the paper sheets S are bound together may be changed. In addition, the paper sheets S may be bound together only by the staples, or only by embossing.

Next, the operation of the image forming system 1 will be described with reference to FIGS. 1 to 5B and 7. FIG. 7 is a timing chart illustrating a process of binding three paper sheets S together into the stack of paper sheets S illustrated in FIG. 6A. In the following description regarding FIG. 7, the three paper sheets S are called a first paper sheet S, a second paper sheet S, and a third paper sheet S in order of formation of a toner image by the image forming apparatus 2.

Before the toner image is formed on the first paper sheet S by the image forming unit 5 in the image forming apparatus 2, the controller 20 drives the stapler motor (not shown) to move the stapler 40 to the home position thereof (position denoted by 40*c* in FIG. 3). Similarly, the controller 20 drives the staple-free-binding-device motor (not shown) to move the staple-free binding device 50 to the home position thereof (position denoted by 50*c* in FIG. 3). The first eject roller 39*a* is positioned at position P1, the paddle unit 37 is positioned at position Pa, and the tamper 38 is positioned at position Py.

First, the toner image is formed on the first paper sheet S by the image forming unit 5 in the image forming apparatus 2. As illustrated in FIG. 1, the first paper sheet S on which the toner image is formed is reversed as necessary by the paper-sheet reversing device 7, and is supplied to the paper-sheet processing apparatus 3 through the eject rollers 9.

In the transporting device 10 of the paper-sheet processing apparatus 3 to which the first paper sheet S is supplied, the first paper sheet S is received by the inlet rollers 11 and is subjected to a punching process as necessary by the puncher 12. Then, the first paper sheet S is transported toward the post-processing device 30 at the downstream side by the first transporting rollers 13 and the second transporting rollers 14.

The first paper sheet S is received by the receiving rollers 31 in the post-processing device 30. The first paper sheet S passes through the receiving rollers 31, is detected by the exit sensor 33 as illustrated in FIG. 2 (see (1) in FIG. 7), and is transported in the first moving direction S1 by the exit rollers 34. At this time, the first paper sheet S is transported through a space between the compiling support unit 35 and the first eject roller 39*a* and a space between the compiling support unit 35 and the paddle unit 37.

After the front end of the first paper sheet S in the first moving direction S1 passes through the space between the compiling support unit 35 and the paddle unit 37, the paddle unit 37 moves downward (in the direction shown by arrow U1 in FIG. 2) from position Pa to position Pb. Accordingly, the paddle unit 37 comes into contact with the first paper sheet S. Then, the first paper sheet S is pushed in the second moving direction S2 in FIG. 2 when the paddle unit 37 is rotated in the direction shown by arrow R in FIG. 2, so that the end-guide edge portion Sa of the first paper sheet S comes into contact with the end guide 35*b*. Then, the paddle unit 37 moves upward (in the direction shown by arrow U2 in FIG. 2) away from the first paper sheet S to position Pa.

Thus, the first paper sheet S is received by the compiling support unit 35. After the end-guide edge portion Sa of the first paper sheet S reaches the end guide 35*b*, the controller 20 drives the tamper 38 so that the tamper 38 moves toward the side guide 35*c* (in the direction shown by arrow C1 in FIG. 3) from position Py to position Px. Accordingly, the tamper 38 pushes the side-guide-free edge portion Sd of the first paper sheet S, and the side-guide edge portion Sb of the first paper sheet S comes into contact with the side guide 35*c*. Then, the tamper 38 moves in a direction away from the side guide 35*c* (in the direction shown by arrow C2 in FIG. 3), so that the tamper 38 is separated from the first paper sheet S and is positioned at position Py.

The second paper sheet S (see (2) in FIG. 7) and the third paper sheet S (see (3) in FIG. 7), on each of which the toner image is formed by the image forming unit 5, are successively supplied to the post-processing device 30 after the first paper sheet S. Similar to the above-described operation, the edge portions of the second paper sheet S and the third paper sheet S are aligned by the paddle unit 37 and the tamper 38. More specifically, the second paper sheet S is supplied in the state in which the first paper sheet S is aligned, and the second paper sheet S is aligned with respect to the first paper sheet S. A similar process is performed for the third paper sheet S. Thus, the preset number of paper sheets S, that is, the three paper sheets S in this example, are placed on the compiling support unit 35 in the form of a stack in which the edge portions of the paper sheets S are aligned.

Next, the edge portions of the paper sheets S stacked on the compiling support unit 35 are bound together.

More specifically, the first eject roller 39*a* moves downward (in the direction shown by arrow Q1 in FIG. 2) from position P1 to position P2. Accordingly, the stack of paper sheets S in the aligned state is clamped and retained by the first eject roller 39*a* and the second eject roller 39*b*.

Then, the stapler motor (not shown) is driven so as to move the stapler 40 from the home position (position denoted by 40*c* in FIG. 3) to the position at which the staple 411 is to be pushed into the stack of paper sheets S. At this position, the staple 411 is pushed into the stack of paper sheets S so that the side-guide edge portions Sb of the paper sheets S are bound together. Then, the stapler motor moves the stapler 40 to the position at which the staple 412 is to be pushed into the stack of paper sheets S, and the paper sheets S are bound together by the staple 412 at this position. A similar process is performed for the position at which the staple 413 is to be pushed into the stack of paper sheets S. Thus, the staples 411 to 413 are pushed into the stack of paper sheets S in order from the side of the end-guide edge portions Sa to the side of the end-guide-free edge portions Sc.

After the staples 411 to 413 are pushed into the stack of paper sheets S, the first eject roller 39*a* moves upward (in the direction shown by arrow Q2 in FIG. 2) from position P2 to position P1.

Here, components for retaining the stack of paper sheets S in the aligned state are not limited to the first eject roller 39*a* and the second eject roller 39*b*, and the stack of paper sheets S may instead be clamped between the paddle unit 37 and the bottom portion 35*a* of the compiling support unit 35.

Then, the staple-free-binding-device motor (not shown) is driven so as to move the staple-free binding device 50 from the home position (position denoted by 50*c* in FIG. 3) to the position at which the embossed mark 511 is to be formed. At this position, the upper pressing portion 52*a* and the lower pressing portion 52*b* of the staple-free binding device 50 are moved toward each other so that the projecting portion 53*a* and the receiving portion 53*b* mesh with each other while the stack of paper sheets S placed therebetween. Accordingly, the embossed mark 511 is formed in each of the paper sheets S and the side-guide-free edge portions Sd of the paper sheets S are bound together. The embossed mark 511 is formed in each of the three paper sheets S that are stacked together, and the paper sheets S are caused to bite into each other. Accordingly, the paper sheets S are bound together. In other words, the paper sheets S are press-fitted to each other.

Then, the staple-free-binding-device motor moves the staple-free binding device 50 to a position where the embossed mark 512 is to be formed. At this position, the paper sheets S are bound together by forming the embossed mark 512. Thus, the embossed marks 511 and 512 are formed in order from the side of the end-guide edge portions Sa to the side of the end-guide-free edge portions Sc.

Then, to move the paper sheets S that are bound together by the staples 411 to 413 and the embossed marks 511 and 512, the first eject roller 39*a* moves downward (in the direction shown by arrow Q1 in FIG. 2) from position P1 to position P2. At position P2, the first eject roller 39*a* rotates in the direction shown by arrow T1 in FIG. 2, so that the stack of paper sheets S is moved from the compiling support unit 35 and is ejected onto the stacker 70 through the opening 69. In this example, the staple-free binding device 50 is stopped at a position where the staple-free binding device 50 is opposed to the side guide 35*c*. Therefore, when the stack of paper sheets S that have been subjected to the binding process is transported from the compiling support unit 35 to the stacker 70, the staple-free binding device 50 does not interfere with the stack of paper sheets S that is being transported.

Here, when a force required to break the bonds provided by the staples 411 to 413 and a force required to break the bonds provided by the embossed marks 511 and 512 are compared with each other, the force with which the paper sheets S are bound together by the staples 411 to 413 is larger than the force with which the paper sheets S are bound together by the embossed marks 511 and 512. Therefore, in the case where a single stack of paper sheets S are bound together by both the staples 411 to 413 and the embossed marks 511 and 512, the paper sheets S may, for example, be securely bound together by the staples 411 to 413 and be bound by the embossed marks 511 and 512 such that the bonds are relatively easily breakable (such that the paper sheets S may be relatively easily separated from each other). An example of a case in which the paper sheets S are bound together such that the paper sheets S may be easily separated from each other is a case in which edge portions of the paper sheets S are temporarily bound together but are expected to be released from each other, such as a case in which the stack of paper sheets S is a booklet of examination papers. Another example is a case in which it is necessary to show that the stack of paper sheets S has not been opened.

As described above, the stack of paper sheets S is released from the first eject roller 39*a* after the paper sheets S are bound together by the stapler 40. Therefore, even if, for example, the stack of paper sheets S is bent between the stapler 40 and the first eject roller 39*a* when the staple 411 is pushed into the stack of paper sheets S, the stack of paper sheets S may restore from the bent state. Therefore, the risk that some of the paper sheets S in the stack of paper sheets S will become wrinkled may be reduced.

With regard to the order in which the edge portions of the paper sheets S are bound together, the binding process in which the embossed marks 511 and 512 are formed is performed after the binding process using the staples 411 to 413. Since the time at which the edge portions of the paper sheets S are bound together by the staples 411 to 413 and the time at which the edge portions of the paper sheets S are bound together by the embossed marks 511 and 512 are shifted from each other, the paper sheets S may be prevented from being bound together while, for example, some of the paper sheets S at the front side of the stack of paper sheets S are raised from the other paper sheets S.

In addition, since the binding process using the staples 411 to 413 is performed before the binding process in which the embossed marks 511 and 512 are formed, the paper sheets S may be bound together such that the edge portions which are bound together by the staples 411 to 413 and at which the bonds are basically not expected to be broken are more neatly aligned than the edge portions which are bound together by the embossed marks 511 and 512 and at which the bonds are expected to be broken.

Even if the edge portions to be bound together by the embossed marks 511 and 512 are roughly aligned in the binding process and are bound together in the roughly aligned state, the edge portions bound together by the staples 411 to 413 are in a neatly aligned state. Therefore, the edge portions bound together by the embossed marks 511 and 512 may be realigned by breaking the bonds provided by the embossed marks 511 and 512.

With regard to the positional relationship between the edge portions of the paper sheets S that are bound together, the side-guide edge portions Sb that come into contact with the side guide 35*c* are bound together by the stapler 40, and the side-guide-free edge portions Sd at the side opposite to the side guide 35*c* are bound together by the staple-free binding device 50.

The reason for this will now be described. In general, even when the paper sheets S of the same size (A4, B5, etc.) are provided, the paper sheets S do not always have the same dimensions because of, for example, manufacturing differences. When, for example, the paper sheets S are aligned by pressing the paper sheets S against the side guide 35*c* with the tamper 38, the side-guide edge portions Sb, which come into contact with the side guide 35*c*, of the paper sheets S are more accurately aligned than the side-guide-free edge portions Sd thereof.

In the case where the edge portions of the paper sheets S are temporarily bound together, as described above, the bonds provided by the embossed marks 511 and 512 are expected to be broken (the paper sheets S are expected to be separated from each other). In the process of breaking the bonds, there is a possibility that the edge portions of the paper sheets S at which the bonds are broken will be deformed. In other words, in the process of breaking the bonds, there is a possibility that the alignment of the edge portions of the paper sheets S will be degraded. Accordingly, a tolerance for degradation of alignment of the edge portions at which the bonds are expected to be broken may be larger than that of the edge portions which are bound together by the staples 411 to 413 and at which the possibility that the bonds will be broken is low.

Therefore, in order for the edge portions in an accurately aligned state to be bound together by the staples 411 to 413, the staples 411 to 413 are provided to bind together the side-guide edge portions Sb that come into contact with the side guide 35*c* and the embossed marks 511 and 512 are provided to bind together the side-guide-free edge portions Sd at the side opposite to the side-guide edge portions Sb.

Figures 6A, 6B, 6C, 6D, 6E:
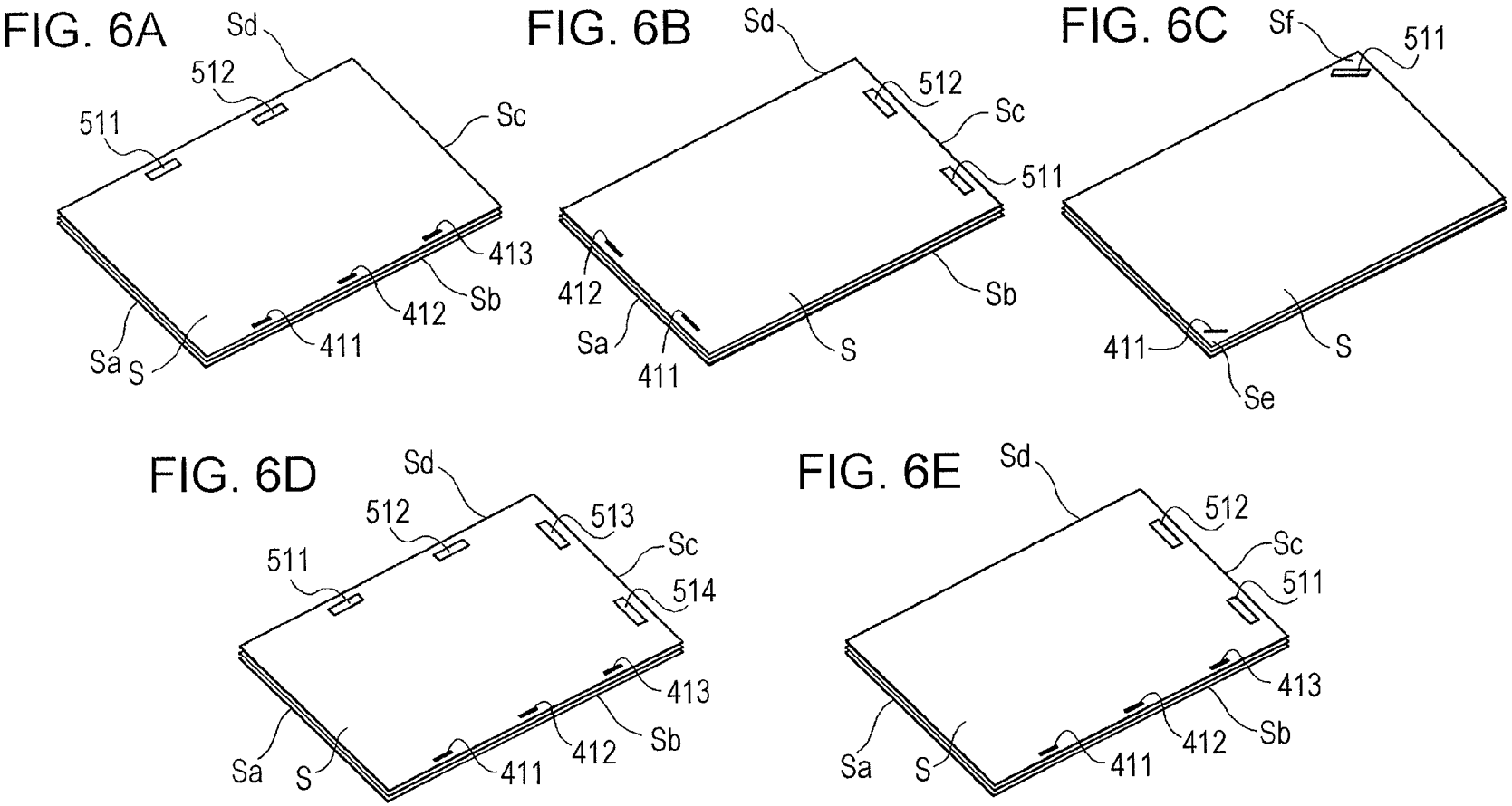
FIGS. 6A to 6E are conceptual diagrams illustrating stacks of sheets subjected to a process according to the exemplary embodiment.
Figure 7:
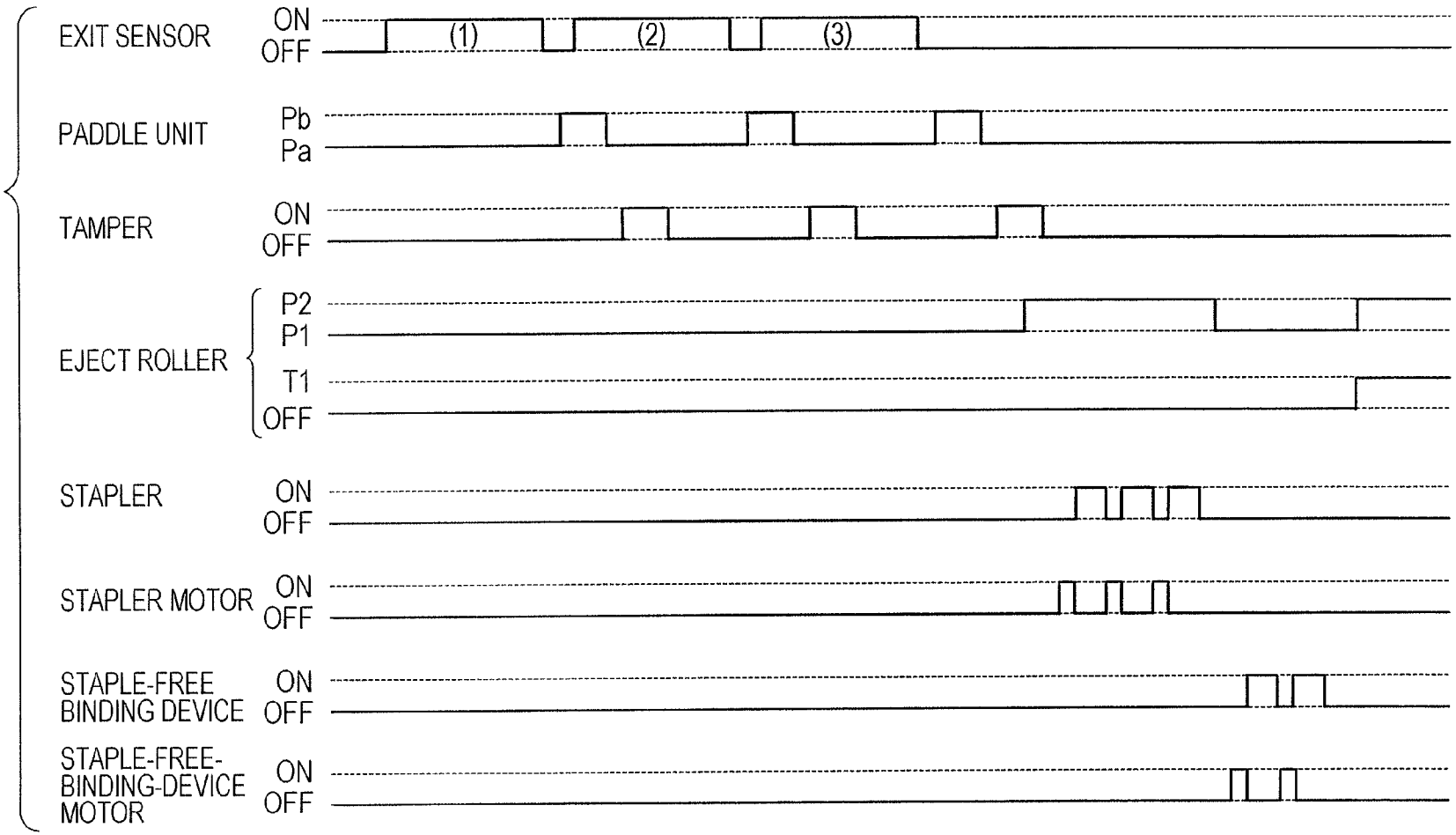
FIG. 7 is a timing chart illustrating the process to which the sheets are subjected according to the exemplary embodiment.

For or a reason similar to that in the above-described case in which the paper sheets S are bound together into the stack of paper sheets S illustrated in FIG. 6A, in FIGS. 6A to 6E, the staples 411 to 413 are provided to bind the end-guide edge portions Sa or the guide corner portions Se together, and the embossed marks 511 and 512 are provided to bind the end-guide-free edge portions Sc or the guide-free corner portions Sf at the opposite side.

Also in the case in which the paper sheets S are bound together into any of the stacks of paper sheets S illustrated in FIGS. 6B to 6E, the staples 411 to 413 are pushed into the paper sheets S in that order, and then the embossed marks 511 to 514 are formed in that order. The reason for this is similar to the above-described reason, that is, to prevent the paper sheets S from being bound together while some of the paper sheets S are raised from the other paper sheets S.

In the present exemplary embodiment, the end guide 35*b* and the side guide 35*c* are fixed to the bottom portion 35*a*. However, the end guide 35*b* and the side guide 35*c* may, for example, be movable relative to the bottom portion 35*a* in accordance with the size of the paper sheets S. In addition, the side guide 35*c* may be structured such that when the tamper 38 moves in the direction shown by arrow C1, the side guide 35*c* moves in the opposite direction, that is, in the direction shown by arrow C2 in accordance with the movement of the tamper 38. In addition, the paddle unit 37 and the tamper 38 may be omitted, and the paper sheets S may be caused to come into contact with the end guide 35*b* and the side guide 35*c* by their own weights.

In addition, although the structure in which the stapler rail and the staple-free-binding-device rail are individually provided is described above, the stapler rail and the staple-free-binding-device rail may be provided as an integral rail. When such an integral rail is provided, the freedom of arrangement of the stapler 40 and the staple-free binding device 50 may be increased.

Although the stapler 40 is described as an example of the first binding unit and the staple-free binding device 50 is described as an example of the second binding unit, the first and second binding units are not limited to the examples described in the present exemplary embodiment. For example, the first and second binding units may be the same type of binding units. More specifically, the first binding unit may be a binding unit that binds sheets together using a first staple, and the second binding unit may be a binding unit that binds sheets together using a second staple that forms a bond that is breakable by a force smaller than that required to break a bond formed by the first staple. Similarly, each of the first and second binding units may be the staple-free binding unit or another type of binding units, such as a binding unit using an adhesive.

The staple-free binding device 50 may be structured as described below.

Figure 8A:
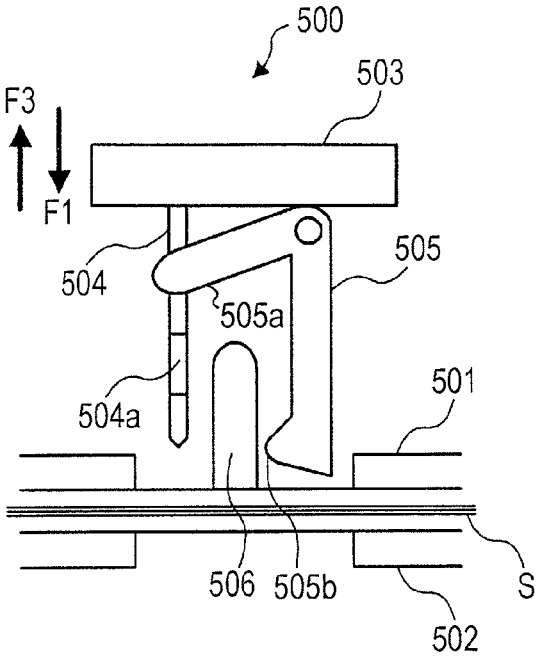
FIGS. 8A to 8D are diagrams illustrating another example of the structure of the staple-free binding device and a stack of paper sheets subjected to a staple-free binding process.

FIGS. 8A to 8D are diagrams illustrating another example of the structure of the staple-free binding device and a stack of paper sheets S processed by the staple-free binding device. As illustrated in FIG. 8A, in this staple-free binding device 500, a base member 503 is pushed downward in a direction shown by arrow F1 in FIG. 8A while the stack of paper sheets S is placed between a base plate 501 and a bottom member 502, so that the paper sheets S are bound together by the following mechanism.

Figure 8B:
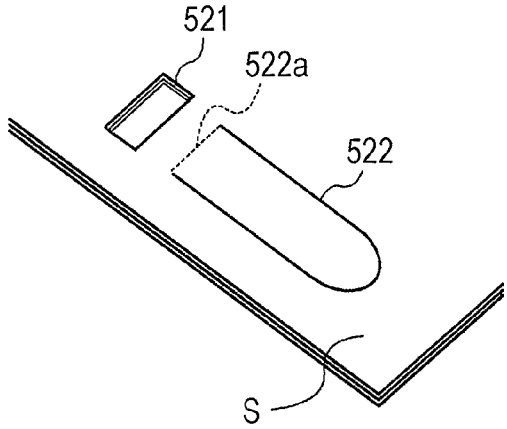
Figure 8C:
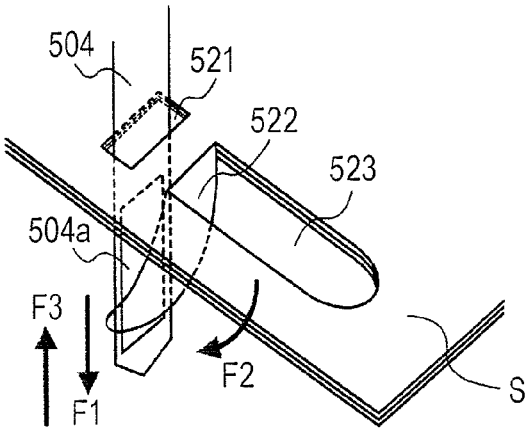
Figure 8D:
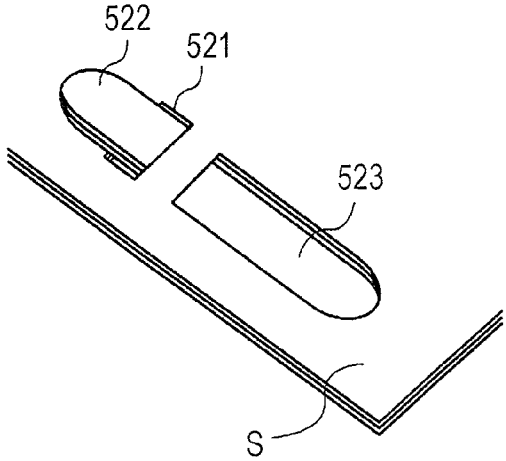

That is, first, a blade 504 and a punching member 505 pierce through the stack of paper sheets S, so that a slit 521 and a tongue-shaped piece 522 are formed in the stack of paper sheets S, as illustrated in FIG. 8B. The tongue-shaped piece 522 is formed by cutting the stack of paper sheets S such that an end portion 522*a* of the tongue-shaped piece 522 is left uncut. Then, when the base member 503 is further pushed downward, an upper end portion 505*a* of the punching member 505 comes into contact with a projecting portion 506 formed integrally with the base plate 501, so that the punching member 505 is caused to rotate clockwise in FIG. 8A. Accordingly, as illustrated in FIG. 8C, the tongue-shaped piece 522 is pushed into an eyelet 504*a*, which is formed in the blade 504, in a direction shown by arrow F2 in FIG. 8C by a projection 505*b* provided at an end of the punching member 505. In FIG. 8C, the punching member 505 is not illustrated. When the base member 503 is moved upward from this state in a direction shown by arrow F3 in FIG. 8C, the blade 504 moves upward while the tongue-shaped piece 522 is caught in the eyelet 504*a* formed in the blade 504. Therefore, as illustrated in FIG. 8D, the tongue-shaped piece 522 is inserted into the slit 521, thereby binding the paper sheets S together. In this state, a binding hole 523 is formed in the stack of paper sheets S at a position where the tongue-shaped piece 522 is cut.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus, comprising:

a support unit on which a plurality of sheets are stacked, each sheet including a first edge portion and a second edge portion that differs from the first edge portion, the sheets being stacked together as a sheet stack such that the first edge portions and the second edge portions of the sheets are aligned;

a counter member disposed so as to face the first edge portions of the sheets stacked on the support unit;

a pressing member that presses the first edge portions of the sheets stacked on the support unit against the counter member;

a first binding unit that binds together the first edge portions of the sheets in the sheet stack by a first binding process, the first edge portion of each sheet being pressed against the counter member by the pressing member; and a second binding unit that binds together the second edge portions of the sheets in the sheet stack by a second binding process, the first edge portion of each sheet being pressed against the counter member by the pressing member, the bond formed by the second binding unit being more easily breakable than a bond formed by the first binding unit, wherein the second edge portions of the sheets are located on an edge of the sheets that is different than an edge on which the first edge portions of the sheets are located.

2. The sheet processing apparatus according to claim 1, wherein the first binding unit performs the first binding process by inserting a staple through the sheet stack, and wherein the second binding unit performs the second binding process by forming a projection and a recess that extend in a direction in which the sheets included in the sheet stack are stacked.

3. The sheet processing apparatus according to claim 1, wherein the first binding unit performs the first binding process at a first side or a first corner between two adjacent sides of each of the sheets included in the sheet stack, the first side or the first corner serving as the first edge portion, and wherein the second binding unit performs the second binding process at a second side opposed to the first side or a second corner opposed to the first corner, the second side or the second corner serving as the second edge portion.

4. The sheet processing apparatus according to claim 1, further comprising:

a transporting unit that successively transports the sheets toward the support unit, wherein each sheet includes a front edge and a rear edge in a sheet transporting direction in which the sheet is transported, a first side edge, and a second side edge, the first and second side edges crossing the front and rear edges and extending along the sheet transporting direction, the first edge portion including the front edge and the first side edge and the second edge portion including the rear edge and the second side edge, wherein the counter member includes a front-edge counter portion that faces the front edge and a side-edge counter portion that faces the first side edge, and wherein the pressing member includes a front-edge pressing portion that presses the front edge of each sheet against the front-edge counter portion and a side-edge pressing portion that presses the first side edge of each sheet against the side-edge counter portion.

5. The sheet processing apparatus according to claim 1, wherein the sheet stack placed on the support unit is subjected to the second binding process performed by the second binding unit after being subjected to the first binding process performed by the first binding unit.

6. A sheet processing system, comprising:

the sheet processing apparatus according to claim 1; and an image forming apparatus that forms images on the sheets and supplies the sheets to the sheet processing apparatus.

7. A sheet processing apparatus, comprising:

a support unit on which a plurality of sheets are stacked, each sheet including a first edge portion and a second edge portion that differs from the first edge portion, the sheets being stacked together as a sheet stack such that the first edge portions and the second edge portions of the sheets are aligned;

a positioning unit that positions the sheet stack placed on the support unit by using the first edge portion of each of the sheets included in the sheet stack as a reference; a first binding unit that binds together the first edge portions of the sheets in the sheet stack by a first binding process, the first edge portion of each sheet being positioned by the positioning unit; and a second binding unit that comprises pressing portions and embossed-mark forming portions that form a bond in the sheets that binds together the second edge portions of the sheets in the sheet stack by a second binding process, the first edge portion of each sheet being positioned by the positioning unit, the bond formed by the second binding unit being more easily breakable than a bond formed by the first binding unit, wherein the second edge portions of the sheets are located on an edge of the sheets that is different than an edge on which the first edge portions of the sheets are located.

8. A sheet processing apparatus comprising:

a support unit on which a plurality of sheets are stacked, each sheet including a first edge portion and a second edge portion that differs from the first edge portion, the sheets being stacked together as a sheet stack such that the first edge portions and the second edge portions of the sheets are aligned;

a counter member disposed so as to face the first edge portions of the sheets stacked on the support unit;

a pressing member that presses the first edge portions of the sheets stacked on the support unit against the counter member;

a first binding unit that binds together the first edge portions of the sheets in the sheet stack by a first binding process, the first edge portion of each sheet being pressed against the counter member by the pressing member; and a second binding unit that comprises a deforming portion that deforms a portion of the sheets such that deformed parts of the sheets engage with each other, the second binding unit binds together the second edge portions of the sheets in the sheet stack by a second binding process, the first edge portion of each sheet being pressed against the counter member by the pressing member, a bond formed by the second binding unit being more easily breakable than a bond formed by the first binding unit, wherein the second edge portions of the sheets are located on an edge of the sheets that is different than an edge on which the first edge portions of the sheets are located.

9. The sheet processing apparatus according to claim 8, wherein the first binding unit performs the first binding process by inserting a staple through the sheet stack, and wherein the second binding unit performs the second binding process by forming a projection and a recess that extend in a direction in which the sheets included in the sheet stack are stacked.

10. The sheet processing apparatus according to claim 8, wherein the first binding unit performs the first binding process at a first side or a first corner between two adjacent sides of each of the sheets included in the sheet stack, the first side or the first corner serving as the first edge portion, and wherein the second binding unit performs the second binding process at a second side opposed to the first side or a second corner opposed to the first corner, the second side or the second corner serving as the second edge portion.

11. The sheet processing apparatus according to claim 8, further comprising:

a transporting unit that successively transports the sheets toward the support unit, wherein each sheet includes a front edge and a rear edge in a sheet transporting direction in which the sheet is transported, a first side edge, and a second side edge, the first and second side edges crossing the front and rear edges and extending along the sheet transporting direction, the first edge portion including the front edge and the first side edge and the second edge portion including the rear edge and the second side edge, wherein the counter member includes a front-edge counter portion that faces the front edge and a side-edge counter portion that faces the first side edge, and wherein the pressing member includes a front-edge pressing portion that presses the front edge of each sheet against the front-edge counter portion and a side-edge pressing portion that presses the first side edge of each sheet against the side-edge counter portion.

12. The sheet processing apparatus according to claim 8, wherein the sheet stack placed on the support unit is subjected to the second binding process performed by the second binding unit after being subjected to the first binding process performed by the first binding unit.

13. A sheet processing system comprising:

the sheet processing apparatus according to claim 8; and an image forming apparatus that forms images on the sheets and supplies the sheets to the sheet processing apparatus.

14. A sheet processing apparatus comprising:

a support unit on which a plurality of sheets are stacked, each sheet including a first edge portion and a second edge portion that differs from the first edge portion, the sheets being stacked together as a sheet stack such that the first edge portions and the second edge portions of the sheets are aligned;

a positioning unit that positions the sheet stack placed on the support unit by using the first edge portion of each of the sheets included in the sheet stack as a reference; a first binding unit that binds together the first edge portions of the sheets in the sheet stack by a first binding process, the first edge portion of each sheet being positioned by the positioning unit; and a second binding unit that comprises a deforming portion that deforms a portion of the sheets such that deformed parts of the sheets engage with each other, the second binding unit binds together the second edge portions of the sheets in the sheet stack by a second binding process, the first edge portion of each sheet being positioned by the positioning unit, a bond formed by the second binding unit being more easily breakable than a bond formed by the first binding unit, wherein the second edge portions of the sheets are located on an edge of the sheets that is different than an edge on which the first edge portions of the sheets are located.

15. The sheet processing apparatus according to claim 14, wherein the first binding unit performs the first binding process by inserting a staple through the sheet stack, and wherein the second binding unit performs the second binding process by forming a projection and a recess that extend in a direction in which the sheets included in the sheet stack are stacked.

16. The sheet processing apparatus according to claim 14, wherein the first binding unit performs the first binding process at a first side or a first corner between two adjacent sides of each of the sheets included in the sheet stack, the first side or the first corner serving as the first edge portion, and wherein the second binding unit performs the second binding process at a second side opposed to the first side or a second corner opposed to the first corner, the second side or the second corner serving as the second edge portion.

17. The sheet processing apparatus according to claim 14, further comprising:

a transporting unit that successively transports the sheets toward the support unit, wherein each sheet includes a front edge and a rear edge in a sheet transporting direction in which the sheet is transported, a first side edge, and a second side edge, the first and second side edges crossing the front and rear edges and extending along the sheet transporting direction, the first edge portion including the front edge and the first side edge and the second edge portion including the rear edge and the second side edge, the sheet processing apparatus further comprising:

a counter member that includes a front-edge counter portion that faces the front edge and a side-edge counter portion that faces the first side edge, and a pressing member that includes a front-edge pressing portion that presses the front edge of each sheet against the front-edge counter portion and a side-edge pressing portion that presses the first side edge of each sheet against the side-edge counter portion.

18. The sheet processing apparatus according to claim 14, wherein the sheet stack placed on the support unit is subjected to the second binding process performed by the second binding unit after being subjected to the first binding process performed by the first binding unit.

19. A sheet processing system, comprising:

the sheet processing apparatus according to claim 14; and an image forming apparatus that forms images on the sheets and supplies the sheets to the sheet processing apparatus.

20. A sheet processing apparatus, comprising:

a support unit on which a plurality of sheets are stacked, each sheet including a first edge portion and a second edge portion that differs from the first edge portion, the sheets being stacked together as a sheet stack such that the first edge portions and the second edge portions of the sheets are aligned;

a counter member disposed so as to face the first edge portions of the sheets stacked on the support unit;

a pressing member that presses the first edge portions of the sheets stacked on the support unit against the counter member;

a first binding unit that binds together the first edge portions of the sheets in the sheet stack by a first binding process, the first edge portion of each sheet being pressed against the counter member by the pressing member; and a second binding unit that binds together the second edge portions of the sheets in the sheet stack by a second binding process, the first edge portion of each sheet being pressed against the counter member by the pressing member, wherein the first binding unit is a stapler, and the second binding unit is a staple-free binding unit, and wherein the second edge portions of the sheets are located on an edge of the sheets that is different than an edge on which the first edge portions of the sheets are located.

* * * * *